US012410623B1

(12) United States Patent
Ying

(10) Patent No.: US 12,410,623 B1
(45) Date of Patent: Sep. 9, 2025

(54) PUTTY SCRAPER

(71) Applicant: Junpiao Ying, Yongkang (CN)

(72) Inventor: Junpiao Ying, Yongkang (CN)

( * ) Notice: Subject to any disclaimer, the term of this patent is extended or adjusted under 35 U.S.C. 154(b) by 0 days.

(21) Appl. No.: 18/952,246

(22) Filed: Nov. 19, 2024

(30) Foreign Application Priority Data

Oct. 16, 2024 (CN) ..... 202422502236.7

(51) Int. Cl.
*E04F 21/32* (2006.01)

(52) U.S. Cl.
CPC ..... *E04F 21/32* (2013.01)

(58) Field of Classification Search
CPC ..... B25G 1/102; B25G 3/18; B64D 29/06; B65D 43/22; B65D 2251/09; B44B 11/00; B44B 11/02; B44B 11/04; B44C 7/027; B44C 7/04; B44C 7/06; B44C 7/08; E04F 21/32; E04F 21/04; E04F 21/06; E04F 21/161; E05C 19/145; E05C 19/14; Y10T 292/0946
See application file for complete search history.

(56) References Cited

U.S. PATENT DOCUMENTS 2,656,225 A * 10/1953 Saylor ..... B25G 1/01 403/243
4,602,812 A * 7/1986 Bourne ..... E05C 19/145 292/DIG. 60
2011/0030224 A1* 2/2011 Wang ..... E04F 21/32 30/169
2011/0030225 A1* 2/2011 Wang ..... E04F 21/32 30/340
2015/0225967 A1* 8/2015 Rampling ..... E04F 21/08 15/245.1
2016/0264250 A1* 9/2016 Hernandez ..... B64D 29/06
2022/0372771 A1* 11/2022 Olejnik ..... E04F 21/161

* cited by examiner

*Primary Examiner* — Galen H Hauth
*Assistant Examiner* — John Robitaille
(74) *Attorney, Agent, or Firm* — Birchwood IP

(57) ABSTRACT

A putty scraper is provided, which includes a sealing piece and a positioning structure provided on the sealing piece. The sealing piece has a sealing state when it is fixed on the positioning structure and an unlocking state when it is detached from the positioning structure. In the sealing state, one end of the sealing piece blocks an end of a gap and prevents a blade from being detached from a handle at the end of the gap. In the unlocking state, the end of the gap is exposed. When it is necessary to extract or replace the blade, the sealing piece is pushed by hand and a positioning block is detached from a positioning groove, and then the sealing piece is rotated to expose the end of the gap. At this time, the blade can be extracted out from the end of the gap.

9 Claims, 6 Drawing Sheets

PUTTY SCRAPER

CROSS-REFERENCE TO RELATED APPLICATIONS

This application claims priority to Chinese Patent Application No. 202422502236.7, filed on Oct. 16, 2024, which is hereby incorporated by reference in its entirety.

TECHNICAL FIELD

The present disclosure relates to the field of building construction tools technologies, and in particular, to a putty scraper.

BACKGROUND

Scraping is a common way for interior wall decoration in buildings, mainly by filling and smoothing a rough cement surface with a mixture of white powder, talcum powder, and cellulose.

In order to better complete the task of scraping, a scraping artifact, also known as a putty scraper, has been launched on the market. In this tool, there is a handle for manual grip, covers are installed on both sides of the handle. A lower side of the handle is equipped with a fixed plate, and a blade can be freely removed and installed in a gap between the handle and the fixed plate. When installing the blade, it is generally necessary to insert a rear end of the blade directly from a front end of the gap. After inserting the blade, due to an inverted structure between the blade and the fixed plate, the blade cannot be extracted out from the front end of the gap. At this time, it is necessary to open one of the covers and then extract out the blade from a left end or a right end of the handle. However, due to a tight fit between the cover and the handle, a worker needs to apply a lot of force to disassemble the cover, which is difficult, and the blade is sharp. When disassembling the cover with force, it is very easy for the blade to accidentally injure the worker due to excessive force, which exits a great safety hazard.

SUMMARY

To solve the above problems, the present disclosure provides a putty scraper.

The technical solution adopted by the present disclosure is: a putty scraper, which includes a handle, a fixed plate provided on the handle, where a gap configured for one end of a blade to be inserted and fixed is formed between the fixed plate and the handle, at least one end of two ends of the handle is provided with a cover, and at least one end of two ends of the gap is extended to the cover; where the putty scraper further includes a sealing piece and a positioning structure provided on the cover, the sealing piece has a sealing state when it is fixed on the positioning structure and an unlocking state when it is detached from the positioning structure; in the sealing state, one end of the sealing piece blocks the end of the gap and prevents the blade from being detached from the handle at the end of the gap; in the unlocking state, the end of the gap is exposed.

The following further provides several implementation modes, but they do not serve as additional limitations on the overall solution mentioned above. They are only further implementation modes. Without technical or logical contradictions, each implementation mode can be combined separately for the overall solution mentioned above, or it can be a combination between multiple implementation modes.

In some embodiments of the present disclosure, the fixed plate is provided on a lower end of the handle, the positioning structure is at least one positioning groove provided at a lower end of the cover, the sealing piece is provided with at least one positioning block; in the sealing state, the positioning block is inserted into the positioning groove.

In some embodiments of the present disclosure, two shaft seats arranged at intervals from each other are provided on one side of the lower end of the cover, and a shaft rod is fixed between the two shaft seats; the sealing piece is provided with a strip-shaped groove configured for the shaft rod to pass through; in the blocking state, the shaft rod is located at a lower end of the strip-shaped groove; in the unlocking state, the shaft rod is located at an upper end of the strip-shaped groove, and the sealing piece is capable of being rotated around the shaft rod.

In some embodiments of the present disclosure, the sealing piece includes a lower connection block and an upper connection block that are integrally formed, the lower connection block is located below the upper connection block, where the strip-shaped groove is extended vertically and is provided on the upper connection block, the lower connection block is provided with a first extension portion, and the positioning block is fixed on the first extension portion; in the sealing state, a lower end of the first extension portion abuts against the lower end of the cover, and one side of the first extension portion is configured to block the end of the gap; in the unlocking state, the first extension portion leaves the lower end of the cover.

In some embodiments of the present disclosure, a second extension portion is further provided on the lower connection block, and the second extension portion is provided on a front side or a rear side of the upper connection block; in the sealing state, the second extension portion abuts against the lower end of the cover, in the unlocking state, the second extension portion leaves the lower end of the cover.

In some embodiments of the present disclosure, the handle is hollow inside, and at least one end of two ends of the handle is provided with a through port; one side of the cover is provided with a convex rib, which is clamped in the through port.

In some embodiments of the present disclosure, the cover is fixed to one side of the handle by adhesive.

In some embodiments of the present disclosure, a guide block is provided at a lower end of the blade, and a limit convex strip is provided at a lower end of the fixed plate that is close to a front of the fixed plate; the guide block passes through the limit convex strip and enters the gap.

In some embodiments of the present disclosure, a front side and a rear side of the handle are both provided with a recess for holding the handle.

In some embodiments of the present disclosure, an upper end of the sealing piece is provided with at least one protrusion block, the cover is provided with an installation groove corresponding to the sealing piece, the fixing structure is at least one slot provided on the cover, the slot is located above the installation groove, and in the sealing state, the protrusion block is inserted upward into the slot.

Compared with the existing technology, the present disclosure has the following beneficial effects.

By rotatably providing the sealing piece on the cover, in the sealing state, the sealing piece can block the end of the gap, thereby preventing the blade from being detached from the handle at the end of the gap. When it is necessary to extract or replace the blade, the sealing piece is pushed by hand and the positioning block is caused to be detached from the positioning groove. The sealing piece is then rotated, and the sealing piece will not block the end of the gap. At this time, the blade can be extracted from the end of the gap, thereby avoiding a safety hazard of accidentally injuring a worker during a disassembly of the cover. The unlocking and relocking of the sealing piece is very labor-saving and convenient, with strong practicality.

BRIEF DESCRIPTION OF DRAWINGS

In order to provide a clearer explanation of the embodiments of the present disclosure or the technical solutions in the prior art, a brief introduction will be given to the accompanying drawings required for the description of the embodiments or the prior art. It is obvious that the accompanying drawings described below are only some embodiments of the present disclosure. For those skilled in the art, other drawings can be obtained based on the structures shown in these drawings without creative work.

Figure 1:
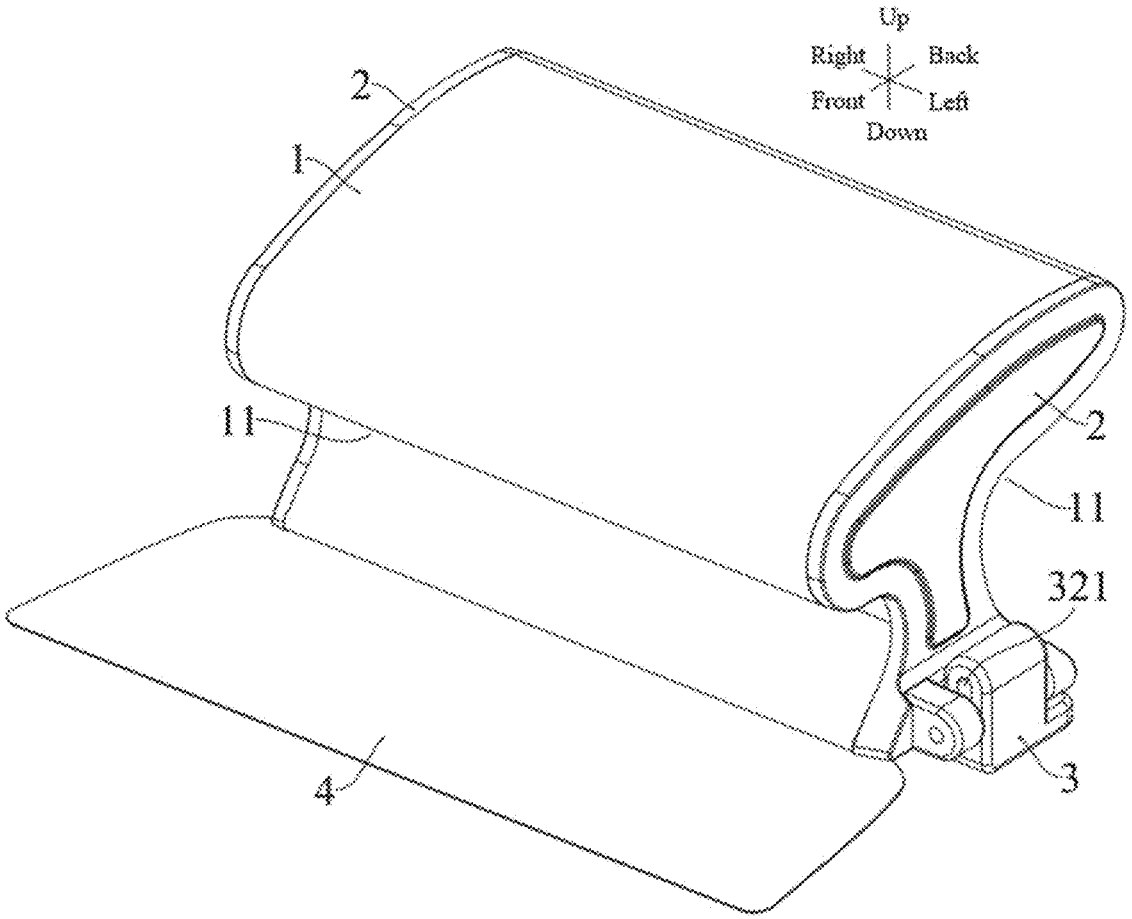
FIG. 1 is an overall structural diagram of a putty scraper in an embodiment of the present application from an upper perspective.

Numeral reference: 1—handle, 11—recess, 12—fixed plate, 121—limit convex strip, 13—gap, 2—cover, 21—positioning groove, 22—shaft seat, 23—shaft rod, 24—convex rib, 3—sealing piece, 31—lower connection block, 311—first extension portion, 312—second extension portion, 32—upper connection block, 321—strip—shaped groove, 33—positioning block, 4—blade.

The implementation, functional characteristics, and advantages of the purpose of the present disclosure will be further explained in combination with the embodiments and with reference to the accompanying drawings.

DESCRIPTION OF EMBODIMENTS

The following will provide a clear and complete description of the technical solution in the embodiments of the present disclosure, based on the accompanying drawings. Obviously, the described embodiments are only a part of the embodiments of the present disclosure, not all of them. Based on the embodiments in the present disclosure, all other embodiments obtained by those skilled in the art without creative work are within the protection scope of the present disclosure.

It should be noted that all directional indications (such as up, down, left, right, front, back, etc.) in this embodiment of the present disclosure are only used to explain a relative position relationship and motion of each component in a specific posture (as shown in the attached drawings). If a specific posture is changed, the directional indication will also be changed accordingly.

In addition, descriptions of "first", "second", etc. in the present disclosure are only for a descriptive purpose and cannot be understood as indicating or implying the relative importance or implying the number of technical features indicated. Therefore, features that are referred to "first" and "second" can explicitly or implicitly include at least one of these features. In addition, the technical solutions between various embodiments can be combined with each other, but they must be based on the ability of those skilled in the art to implement them. When the combination of technical solutions is contradictory or impossible to achieve, it should be considered that this combination of technical solutions does not exist and is not within the protection scope required by the present disclosure.

Specific implementation mode: referring to FIGS. 1-6, the present disclosure provides a putty scraper. The putty scraper includes a handle 1, the handle 2 is provided with a fixed plate 12. A gap 13 configured for one side of a blade to be inserted and fixed is provided between the fixed plate 12 and the handle 1. At least one end of two (left and right) ends of the handle 1 is provided with a cover 2, and at least one end of two (left and right) ends of the gap 13 is extended to the cover 2. The putty scraper further includes a sealing piece 3 and a positioning structure provided on the cover 2. The sealing piece 3 has a sealing state when it is fixed on the positioning structure and an unlocking state when it is detached from the positioning structure. In the sealing state, one end of the sealing piece 3 blocks an end of the gap 13 and prevents the blade 4 from being detached from the handle 1 at the end of the gap 13. In the unlocking state, the end of the gap 13 is exposed.

Figure 2:
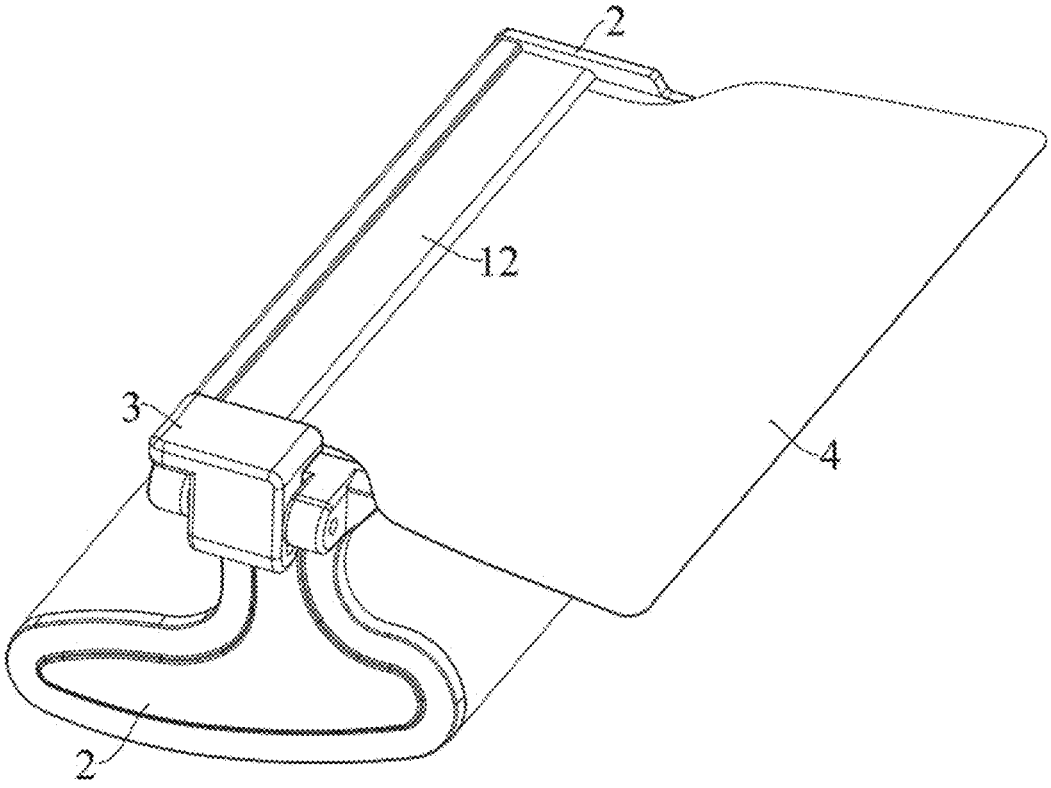
FIG. 2 is an overall structural diagram of the putty scraper according to an embodiment of the present application from a lower perspective.

In an implementation mode, please refer to FIGS. 1 and 2. It can be seen that the fixed plate 12 is provided on a lower end of the handle 1, and the positioning structure is at least one positioning groove 21 provided at a lower end of the cover 2. The sealing piece 3 is provided with at least one positioning block 33. In the sealing state, the positioning block 33 is inserted into the positioning groove 21.

In this embodiment, in order to render a connection between the sealing piece 3 and the cover 2 more stable, two positioning blocks 33 and two positioning grooves 21 are provided, and the two positioning blocks 33 are arranged at intervals from each other.

Figure 4:
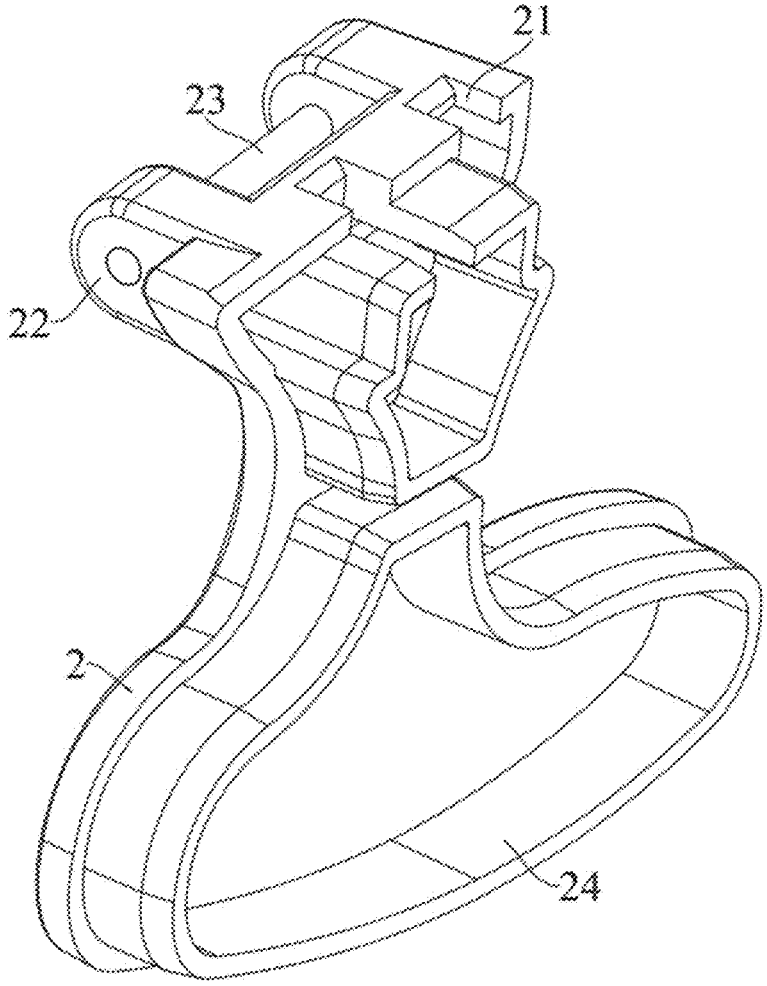
FIG. 4 is a schematic structural diagram of a cover in an embodiment of the present application.

Please refer to FIG. 4, it can be seen that in this embodiment, two shaft seats 22 arranged at intervals from each other are provided on one side of the lower end of the cover 2, and a shaft rod 23 is fixed between the two shaft seats 22. The sealing piece 3 is provided with a strip-shaped groove 321 configured for the shaft rod 23 to pass through. In the sealing state, the shaft rod 23 is located at a lower end of the strip-shaped groove 321, and in the unlocking state, the shaft rod 23 is located at an upper end of the strip-shaped groove 321, and the sealing piece 3 can be rotated around the shaft rod 23.

Figure 3:
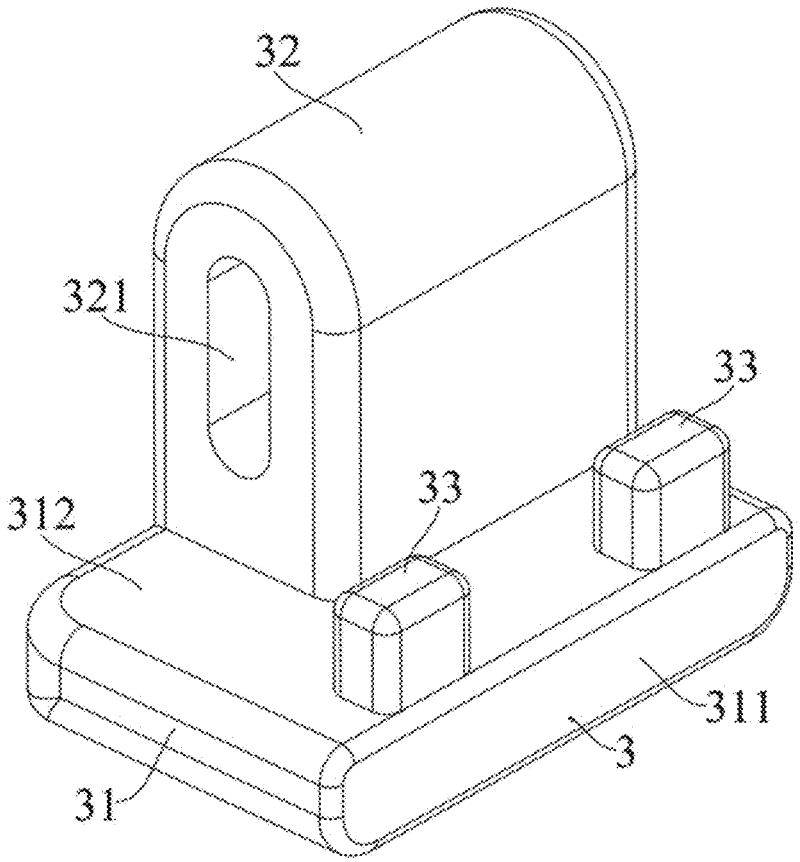
FIG. 3 is a schematic structural diagram of a sealing piece in an embodiment of the present application.

Then, referring to FIG. 3, it can be seen that in this embodiment, the sealing piece 3 includes a lower connection block 31 and an upper connection block 32 that are integrally formed. The lower connection block 31 is located below the upper connection block 32, the strip-shaped groove 321 is extended vertically and is provided on the upper connection block 32. The lower connection block 31 is provided with a first extension portion 311, and the positioning block 33 is fixed on the first extension portion 311. In the sealing state, a lower end of the first extension portion 311 abuts against the lower end of the cover 2, and one side of the first extension portion 311 is configured to block the end of the sealing the gap 13. In the unlocking state, the first extension portion 311 leaves the lower end of the cover 2.

Here, the setting of the first extension portion 311 can be used for installing the positioning block 33 on the one hand and can be cooperated to block the end of the gap 13 on the other hand.

Figure 6:
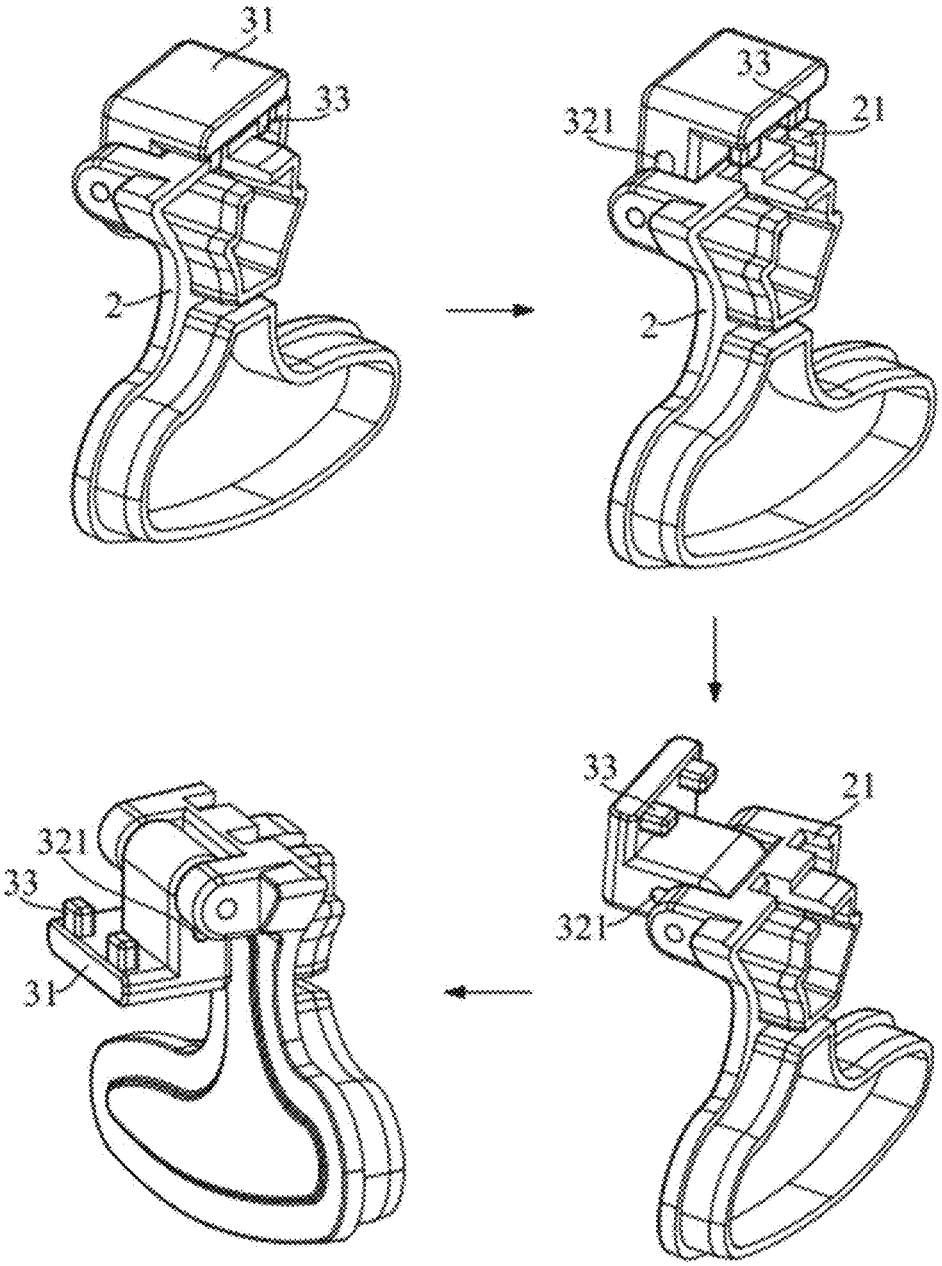
FIG. 6 is a schematic diagram of a process of unlocking the sealing piece in an embodiment of the present application.

Please refer to FIG. 6. Below is an explanation of the unlocking principle of the sealing component 3.

When it is necessary to unlock the sealing piece 3, one side of the blade 4 is firstly turned upwards, that is, the handle 1 is flipped at 180°, which can facilitate an operation (a schematic diagram in FIG. 6 is a schematic diagram of an upper view of the cover 2 being flipped, and the sealing piece 3 being located above); the upper connection block 32 is then pushed upwards. At this time, the positioning block 33 is detached from the positioning groove 21 upwards, and the shaft rod 23 is moved to one end of the strip-shaped groove 321 away from the lower connection block 31; then, the lower connection block 31 is manually moved and the sealing piece 3 is driven to be rotated counterclockwise around the shaft rod 23 until the lower connection block 31 is located below the upper connection block 32. At this time, the end of the gap 13 is exposed, and a worker can drive the blade 4 to be extracted laterally from the end of the gap 13.

In addition, in this embodiment, a lower end of the blade 4 is provided with a guide block, and a lower end of the fixed plate 12 that is close to a front of the fixed plate 12 is provided with a limit convex strip 121. The guide block passes through the limit convex strip 121 and enters the gap 13.

Here, regarding the structural design of the guide block and the limit convex strip, it belongs to the existing technology, and only a brief explanation is given here. Please refer to FIG. 5. It can be seen that when it is necessary to install the blade 4 on the handle 1, a rear end of the blade 4 is directly inserted into a front end of the gap 13 with force. As both the fixed plate 12 and the handle 1 are made of plastic material, the fixed plate 12 will be bent slightly upwards. At this time, the guide block on the blade 4 can also pass through the gap between the limit convex strip 121 and the handle 1. When the guide block enters the gap 13, the fixed plate 12 returns to deformation, and the guide block and the limit convex strip 121 are cooperated to limit the blade 4 from being detached from the front of the handle 1.

It should be noted that before reinstalling the blade 4, it is generally necessary to switch the sealing piece 3 back to the sealing state. Similarly, one side of the blade 4 needs to be turned up first. Then, the worker needs to manually push the lower connection block 31 and drive the sealing piece 3 to be rotated clockwise around the shaft rod 23, rendering the lower connection block 31 located above the upper connection block 32; next, the lower connection block 31 is pressed down and the positioning block 33 is inserted into the positioning groove 21, and the sealing state is completed.

It should be noted that in this embodiment, the positioning block 33 and the positioning groove 21 are generally interference fit. When the positioning block 33 is inserted into the positioning groove 21, a slight force is required to drive the positioning block 33 to be detached from the positioning groove 21. In this way, it can prevent the positioning block 33 from being automatically detached from the positioning groove 21 during using this tool, rendering the structure more stable and the installation of the blade 4 safer.

Please refer to FIG. 3, it can be seen that in this embodiment, the lower connection block 31 is further provided with a second extension portion 312, which is provided on a front side or a rear side of the upper connection block 32. In the sealing state, the second extension portion 312 abuts against the lower end of the cover 2, and in the unlocking state, the second extension portion 312 leaves the lower end of the cover 2.

Here, the setting of the second extension portion 312 can render a contact area between the sealing piece 3 and the lower end of the cover 2 larger in the sealing state, thereby rendering an installation structure of the sealing piece 3 more stable.

Figure 5:
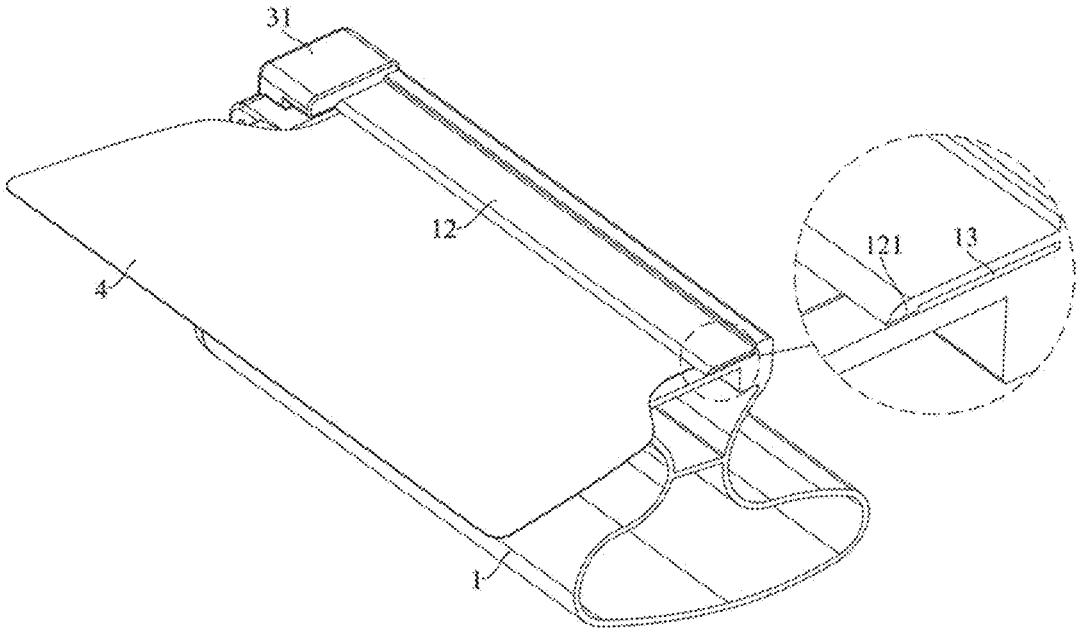
FIG. 5 is an overall structural diagram of the putty scraper after the cover is removed in an embodiment of the present application.

Then, referring to FIGS. 4 and 5, it can be seen that in this embodiment, an interior of the handle 1 is hollow, and at least one end of two (left and right) ends of the handle 1 is provided with a through port. One side of the cover 2 is provided with a convex rib 24, and the convex rib 24 is clamped in the through port.

Here, the handle 1 is set to be internally hollow, which can reduce the weight of the handle 1 and lower the cost of raw materials without affecting a structural strength of the handle 1. This is the existing technology.

In addition, in this embodiment, in order to increase the aesthetics and symmetry of the product, two (left and right) ends of the handle 1 are provided with through ports, that is to say, the two ends of the handle 1 are provided with the cover 2. Of course, the blade 4 only needs to be installed on one of the covers 2.

In addition, due to the installation of the blade 4 on the cover 2, there is no need to disassemble the cover 2. Therefore, the cover 2 can be fixed to one side of the handle 1 with adhesive, which will render the overall structure more stable.

Please refer to FIG. 1. In order to facilitate the holding of the handle 1, in this embodiment, both a front side and a rear side of the handle 1 are provided with a recess 11 for holding the handle 1.

Below is a brief explanation of another setting manner of the sealing piece 3 (a first embodiment is described above, and this is a second embodiment): in this embodiment, an upper end of the sealing piece 3 is provided with at least one protrusion block, and the cover 2 is provided with an installation groove corresponding to the sealing piece 3. The fixed structure is at least one slot provided on the cover 2, and the slot is located above the installation groove. In the sealing state, the protrusion block is inserted upward into the slot (not shown in the drawings).

Here, when it is necessary to unlock the sealing piece 3, it is necessary to pull down the sealing piece 3 (an outer side of the sealing piece 3 will have anti-slip patterns) and render the protrusion block to be detached from the slot. At this time, the sealing piece 3 can be rotated to expose the end of the gap 13, and then the blade 4 can be pulled out.

The putty scraper of the present disclosure is only preferred embodiments of the present disclosure and does not limit the scope of the present disclosure. Any equivalent structural transformation made under the inventive concept of the present disclosure with the content of the specification and drawings, or directly/indirectly applied in other related technical fields, are included in the protection scope of the present disclosure.

What is claimed is:

1. A putty scraper, comprising:

a handle, a fixed plate provided on the handle, wherein a gap configured for one end of a blade to be inserted and fixed is formed between the fixed plate and the handle, at least one end of two ends of the handle is provided with a cover, and at least one end of two ends of the gap is extended to the cover;

wherein the putty scraper further comprises a sealing piece and a positioning structure provided on the cover, the sealing piece has a sealing state when it is fixed on the positioning structure and an unlocking state when it is detached from the positioning structure;

in the sealing state, one end of the sealing piece blocks the end of the gap and prevents the blade from being detached from the handle at the end of the gap;

in the unlocking state, the end of the gap is exposed;

wherein the sealing piece comprises a lower connection block and an upper connection block that are integrally formed; a second extension portion is further provided on the lower connection block, and the second extension portion is provided on a front side or a rear side of the lower connection block;

two shaft seats arranged at intervals from each other are provided on one side of a lower end of the cover, and a shaft rod is fixed between the two shaft seats;

the sealing piece is provided with a strip-shaped groove configured for the shaft rod to pass through;

in the blocking state, the shaft rod is located at a lower end of the strip-shaped groove, in the unlocking state, the shaft rod is located at an upper end of the strip-shaped groove, and the sealing piece is rotated around the shaft rod.

2. The putty scraper according to claim 1, wherein the fixed plate is provided on a lower end of the handle, the positioning structure is at least one positioning groove provided at the lower end of the cover, the sealing piece is provided with at least one positioning block;

in the sealing state, the positioning block is inserted into the positioning groove.

3. The putty scraper according to claim 2 wherein the lower connection block is located below the upper connection block, wherein the strip-shaped groove is extended vertically and is provided on the upper connection block, the lower connection block is provided with a first extension portion, and the positioning block is fixed on the first extension portion; in the sealing state, a lower end of the first extension portion abuts against the lower end of the cover, and one side of the first extension portion is configured to block the end of the gap; in the unlocking state, the first extension portion leaves the lower end of the cover.

4. The putty scraper according to claim 3, wherein in the sealing state, the second extension portion abuts against the lower end of the cover, in the unlocking state, the second extension portion leaves the lower end of the cover.

5. The putty scraper according to claim 1, wherein the handle is hollow inside, and at least one end of two ends of the handle is provided with a through port;

one side of the cover is provided with a convex rib, which is clamped in the through port.

6. The putty scraper according to claim 1, wherein the cover is fixed to one side of the handle by adhesive.

7. The putty scraper according to claim 1, wherein a guide block is provided at a lower end of the blade, and a limit convex strip is provided at a lower end of the fixed plate that is close to a front of the fixed plate;

the guide block passes through the limit convex strip and enters the gap.

8. The putty scraper according to claim 1, wherein a front side and a rear side of the handle are both provided with a recess for holding the handle.

9. The putty scraper according to claim 1, wherein an upper end of the sealing piece is provided with at least one protrusion block, the cover is provided with an installation groove corresponding to the sealing piece, the fixing structure is at least one slot provided on the cover, the slot is located above the installation groove, and in the sealing state, the protrusion block is inserted upward into the slot.

* * * * *